United States Patent [19]

Vishlizky

[11] Patent Number: 4,639,222

[45] Date of Patent: Jan. 27, 1987

[54] GUNNERY TRAINING APPARATUS

[75] Inventor: Yoram Vishlizky, Haifa, Israel

[73] Assignee: State of Israel, Ministry of Defense, Armament, Haifa, Israel

[21] Appl. No.: 521,718

[22] Filed: Aug. 9, 1983

[30] Foreign Application Priority Data

Aug. 9, 1982 [IL] Israel ..... 66497

[51] Int. Cl.[4] ..... F41F 27/00

[52] U.S. Cl. ..... 434/20; 434/43

[58] Field of Search ..... 434/20, 21, 22, 43, 434/44

[56] References Cited

U.S. PATENT DOCUMENTS

| | | | |
|---|---|---|---|
| 2,392,142 | 1/1946 | Gosswiller | 434/20 |
| 2,999,322 | 9/1961 | Hemstreet | 434/43 |
| 3,729,581 | 4/1973 | Anderson | 340/147 R |
| 3,820,253 | 6/1974 | Willey | 434/16 |
| 4,020,468 | 4/1977 | Silver et al. | 340/172.5 |
| 4,136,467 | 1/1979 | O'Rourke | 434/21 |
| 4,194,304 | 3/1980 | Wolcott | 434/18 |
| 4,209,832 | 6/1980 | Gilham et al. | 434/20 |
| 4,260,384 | 4/1981 | Hill | 434/16 |
| 4,333,152 | 6/1982 | Best | 273/DIG. 28 |
| 4,439,156 | 3/1984 | Marshall et al. | 434/22 |
| 4,474,501 | 10/1984 | LaRussa | 434/43 |

FOREIGN PATENT DOCUMENTS

| | | |
|---|---|---|
| 1951622 | 5/1971 | Fed. Rep. of Germany . |
| 2332094 | 1/1974 | Fed. Rep. of Germany . |
| 2128961 | 10/1975 | Fed. Rep. of Germany . |
| 2812201 | 9/1979 | Fed. Rep. of Germany . |
| 3122384 | 12/1982 | Fed. Rep. of Germany . |
| 83/01832 | 5/1983 | PCT Int'l Appl. . |
| 2047856 | 12/1980 | United Kingdom . |

OTHER PUBLICATIONS

Tank Gunnery Trainer, Model MK60, manufactured by Perceptronics of the U.S.A.

*Primary Examiner*—Leo P. Picard

*Attorney, Agent, or Firm*—Burgess, Ryan & Wayne

[57] ABSTRACT

A gunnery training system comprising a fire control unit located at a trainee location and including an aiming sight, an aiming controller, and a trigger; a video display viewable through the aiming sight and providing a field of view through the aiming sight corresponding to the actual view of a target through the aiming sight of an actual gun; apparatus for sensing the orientation of the trainee's line of sight or of a simulated or actual gun provided by the operation of the aiming controller by the trainee; apparatus for determining the trajectory of a simulated projectile relative to the target provided by the sensed orientation produced by the trainee's operation of the aiming controller; a library of video records of actual projectile trajectories and impacts for various orientations of an actual gun relative to the target shown on the display as seen through the aiming sight; and apparatus responsive to operation of the trigger and to an output from the determining apparatus for selecting a video record from the library and displaying it on the display in a time relationship to trigger actuation which corresponds generally to the time relationship between trigger actuation and the displayed events in actual firing.

12 Claims, 10 Drawing Figures

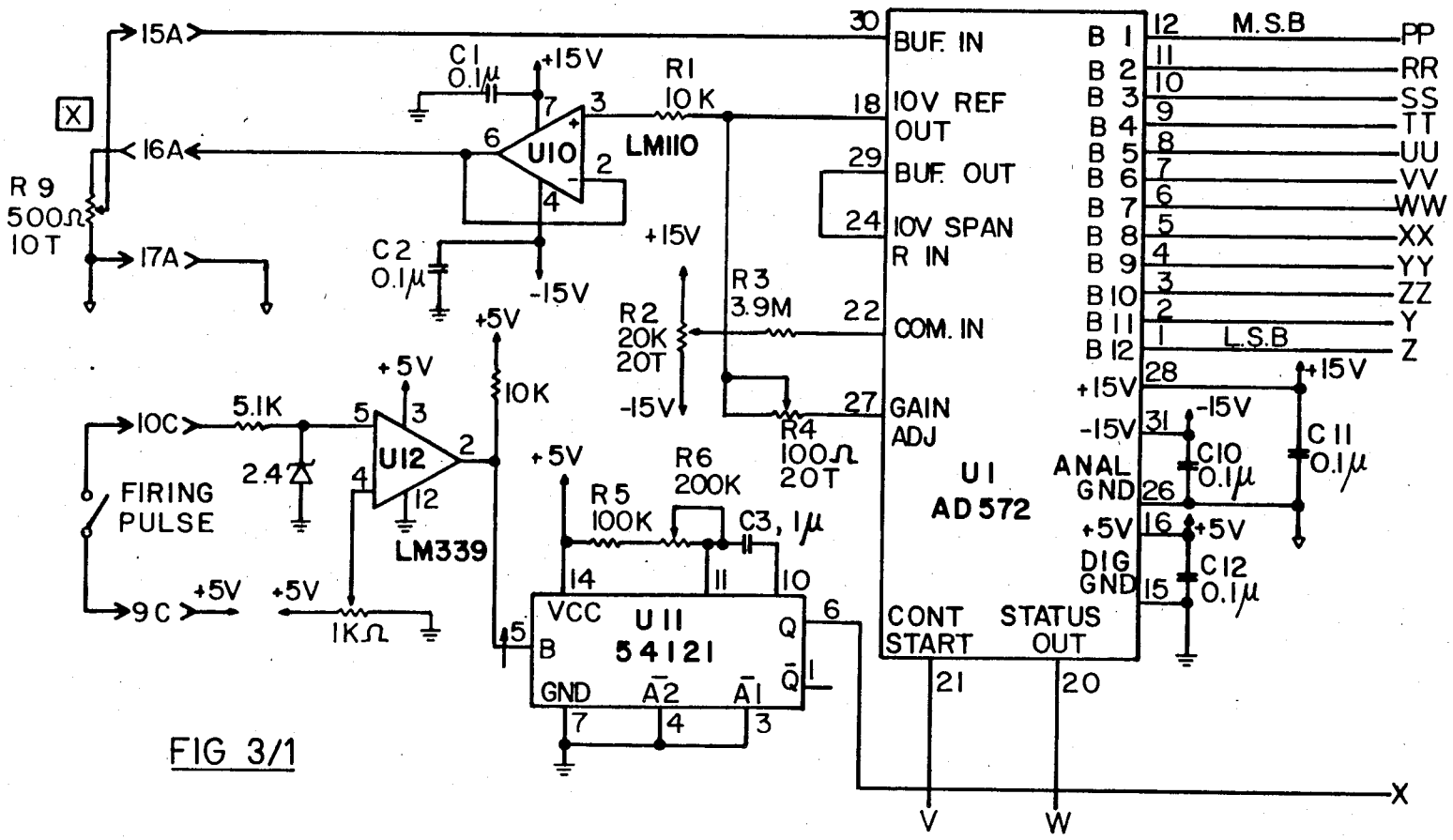
FIG 3/1

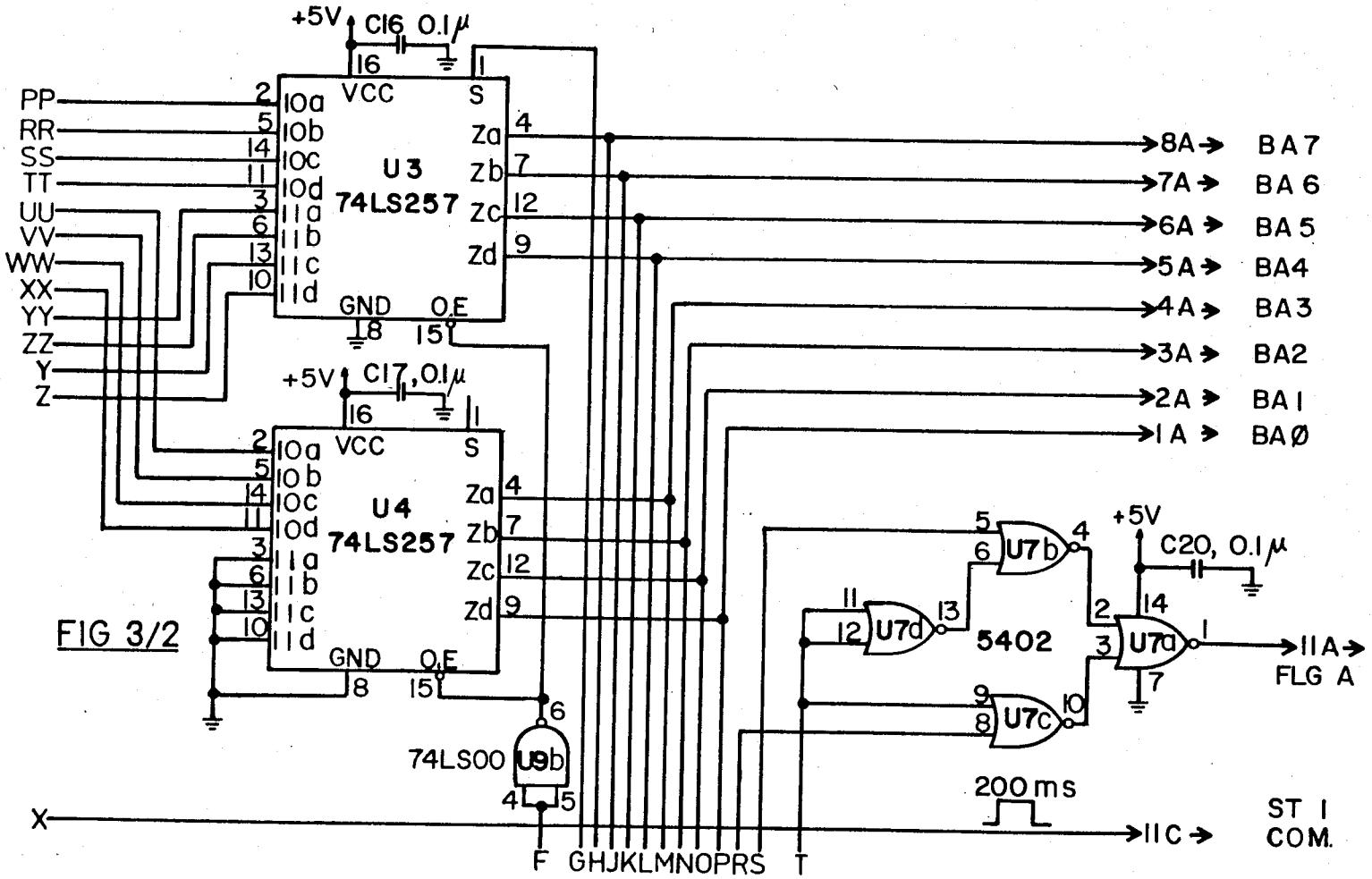
FIG 3/2

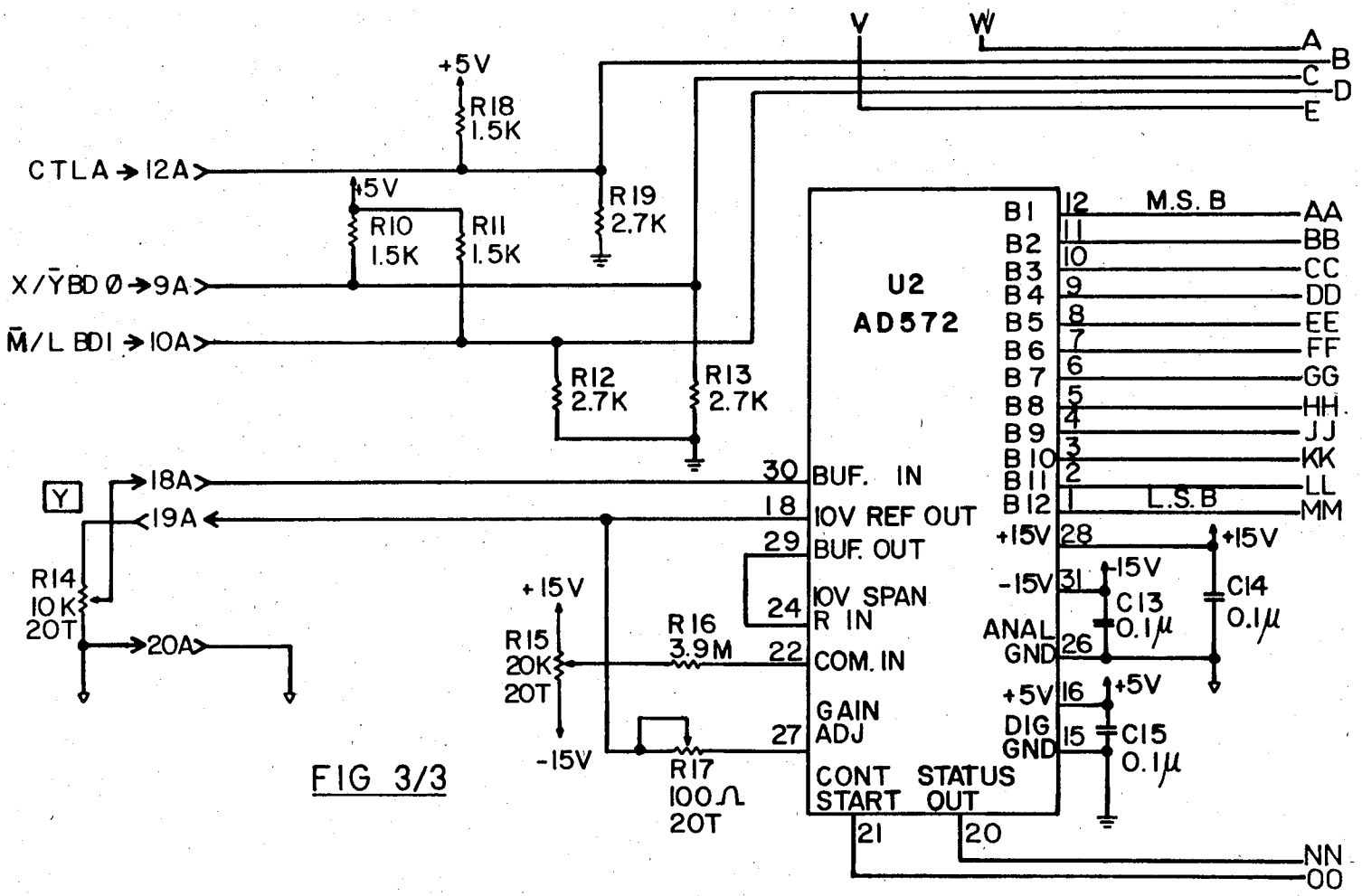
FIG 3/3

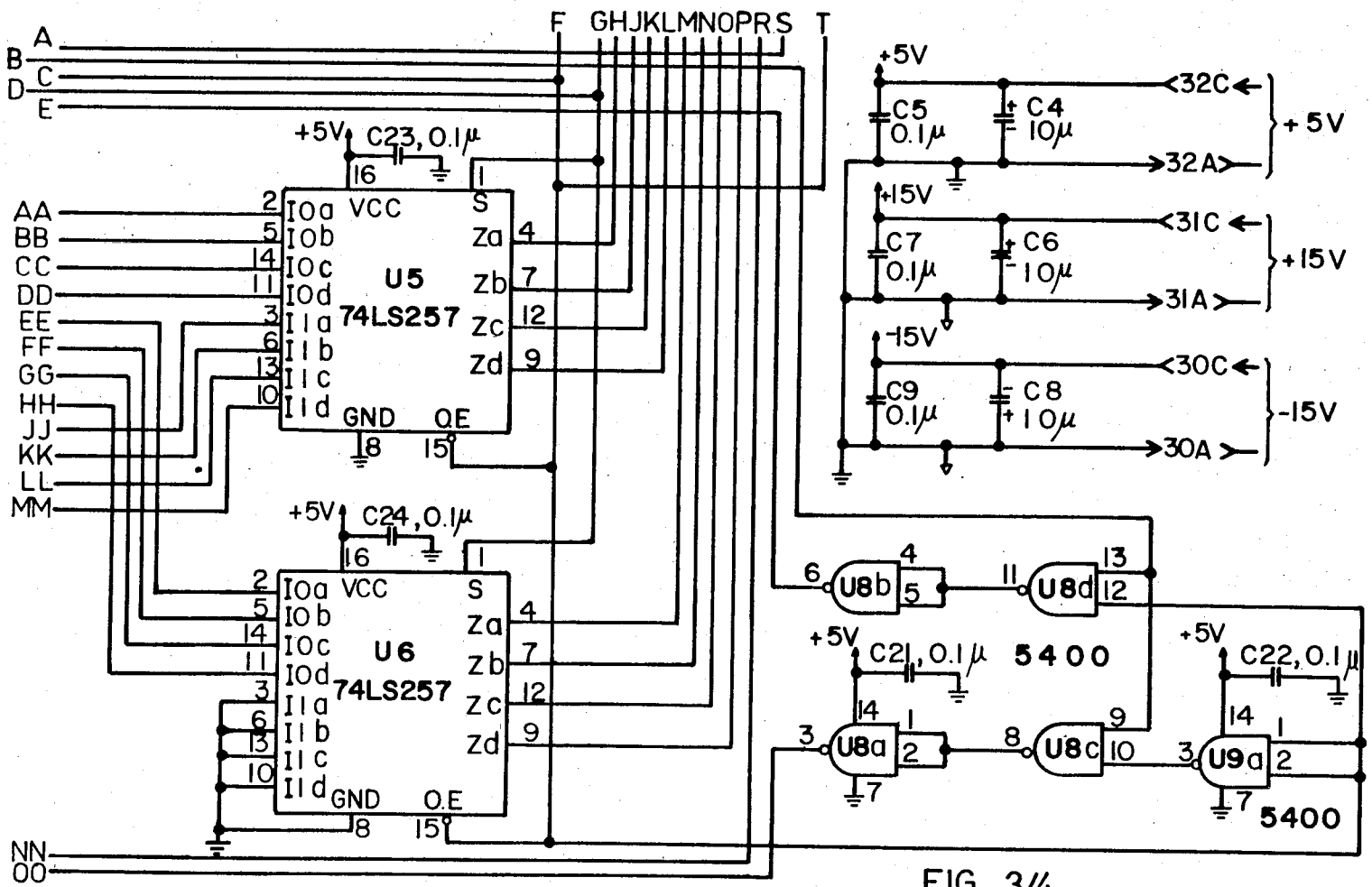
FIG 3/4

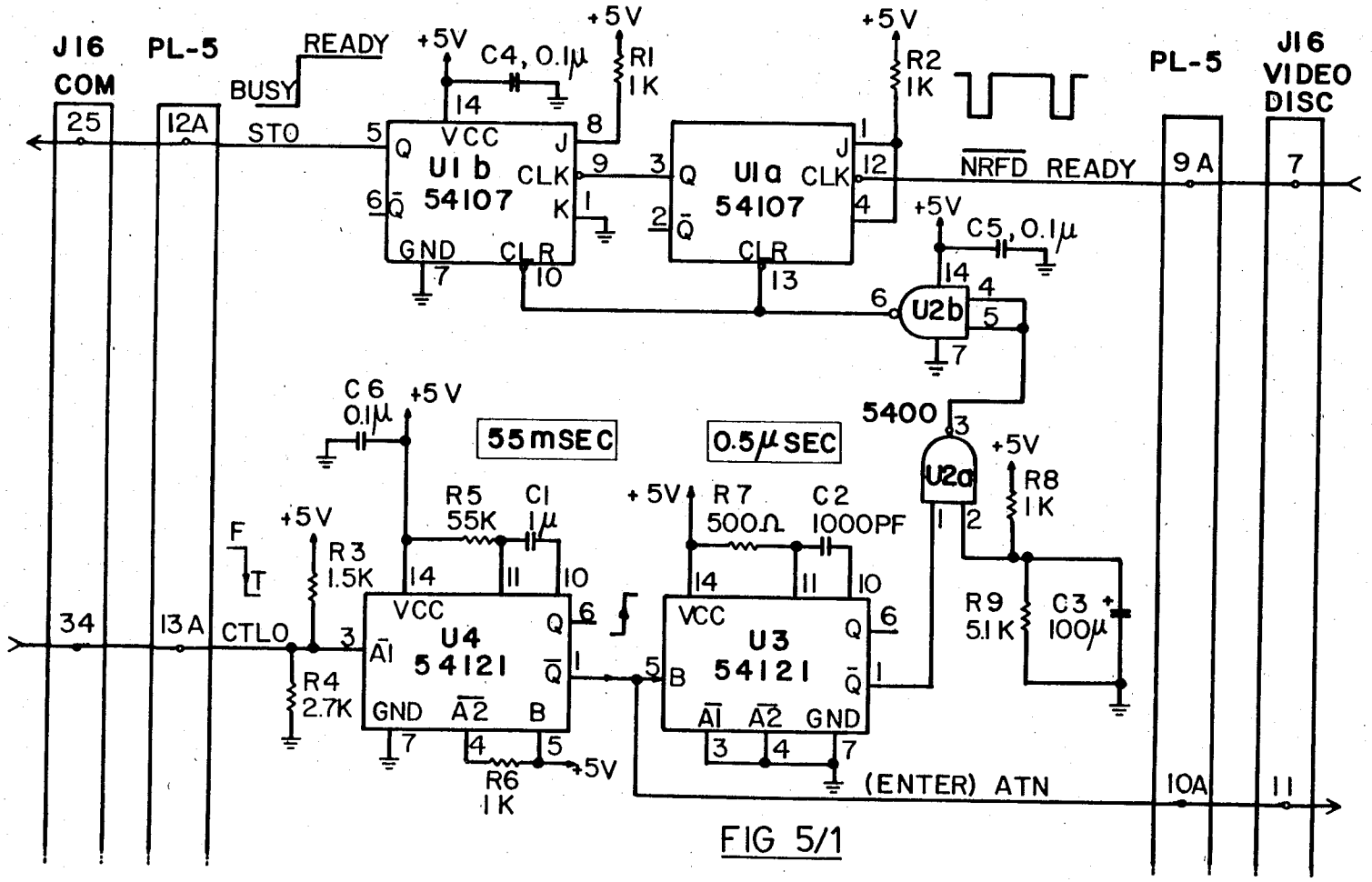
FIG 5/1

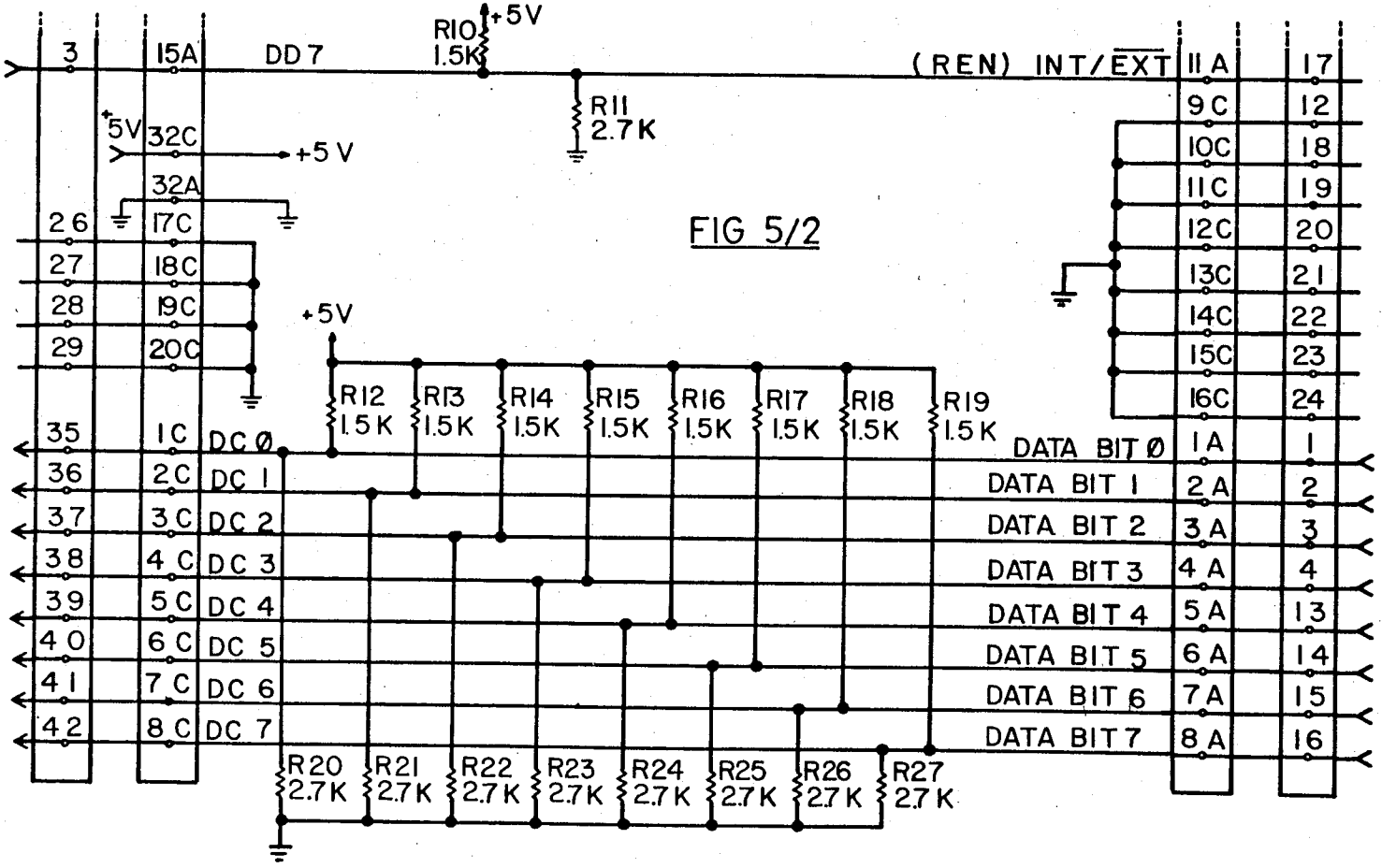
FIG 5/2

GUNNERY TRAINING APPARATUS

FIELD OF THE INVENTION

The present invention relates to training apparatus generally and more particularly to gunnery training apparatus.

BACKGROUND OF THE INVENTION

Various types of gunnery training apparatus are known in the marketplace and have been proposed in the patent literature. U.S. Pat. No. 3,820,253 describes a gunnery trainer which employs a slide projector for projecting realistic target scenes. Simulated aiming of a gun under trainee control is effected by movement of the projected target scene relative to the reticle.

U.S. Pat. No. 4,136,467 describes apparatus and a technique for imparting stabilization error to the line of sight of a simulator. The simulator contains a real time record of stabilization error experienced by the line of sight of the fire control combat system being simulated.

U.S. Pat. No. 4,194,304 describes leader and recoil simulator apparatus which, using a hydraulic jack, simulates the recoil forces encountered during actual firing. U.S. Pat. No. 4,260,384 describes an obscuration device for tank gunners which is operative to automatically and selectively obscure the view out of the tank seen by the gunner in response to the firing of the main gun of the tank so as to simulate the obscuration produced by smoke, heat and debris during an actual firing.

There is also known a tank gunnery trainer manufactured by Perceptronics of the U.S.A. and known as model MK 60. This trainer employs a plurality of video images stored on a video disk device, each of the images corresponding to a different still or moving target. The trajectory of a projectile "fired" by a trainee is not shown on the video image, but instead, the effect of the firing is overlaid on the video image seen by the trainee by means of simulated imaging techniques on the display. Gunnery training systems of conventional construction are extremely costly, complex, and maintenance intensive.

Information retrieval systems are known wherein a video playback system and a video cassette library are employed. U.S. Pat. No. 4,020,468 shows such a system, while U.S. Pat. No. 3,729,581 describes a computer assisted dial access video retrieval system for an instructional television system, employing video tapes.

SUMMARY OF THE INVENTION

The present invention seeks to provide a gunnery training system which is characterized by relative simplicity and low cost and which provides the trainee with an enhanced multi-sense simulation of actual gun firing conditions.

There is thus provided in accordance with an embodiment of the present invention, a gunnery training system comprising a fire control unit located at a trainee location and including an aiming sight, an aiming controller, and a trigger; a video display viewable through the aiming sight and providing a field of view through the aiming sight corresponding to the actual view of a target through the aiming sight of an actual gun; apparatus for sensing the orientation of the trainee's line of sight or of a simulated or actual gun provided by the operation of the aiming controller by the trainee; apparatus for determining the trajectory of a simulated projectile relative to the target provided by the sensed orientation produced by the trainee's operation of the aiming controller; a library of video records of actual projectile trajectories and impacts for various orientations of an actual gun relative to the target shown on the display as seen through the aiming sight; and apparatus responsive to operation of the trigger and to an output from the determining apparatus for selecting a video record from the library and displaying it on the display in a time relationship to trigger actuation which corresponds generally to the time relationship between trigger actuation and the displayed events in actual firing.

Further in accordance with an embodiment of the present invention, there is also provided apparatus for providing additional sensible stimuli to the trainee in response to trigger actuation. These stimuli may include one or more of the following: sound stimuli which simulate the sounds of firing and may also simulate the sound of the impacting projectile, light stimuli to simulate the flash produced by firing, and force stimuli, to simulate the recoil of the gun barrel. The force stimuli may also simulate the recoil force exerted on the entire tank as the result of firing.

Additionally in accordance with an embodiment of the present invention there is also provided an instructor's location which is arranged to enable the instructor to view the same display seen by the trainee and to receive inputs indicating the orientation produced by the trainee's operation of the aiming controller.

According to a preferred embodiment of the present invention, the library contains displays of a plurality of targets and films of a plurality of trajectories corresponding to a plurality of aimed orientations for each target. The individual trajectories are selected to provide resolution within the range of ballistic dispersion of a projectile.

According to a preferred embodiment of the present invention, the library is embodied in a prerecorded video disk and the selecting apparatus comprises a conventional industrial video disk player.

It is a particular feature of the present invention that in contrast to the prior art which shows a static image of the target, the present invention provides a dynamic illustration of the trajectory of the projectile as seen from an actual tank.

BRIEF DESCRIPTION OF THE DRAWINGS

The present invention will be understood and appreciated more fully from the following detailed description taken in conjunction with the drawings in which:

FIG. 3 is a schematic illustration of A-D conversion circuitry employed in the invention;

FIG. 5 is a schematic illustration of video disk interface circuitry employed in the invention.

DETAILED DESCRIPTION OF THE INVENTION

Figure 1:
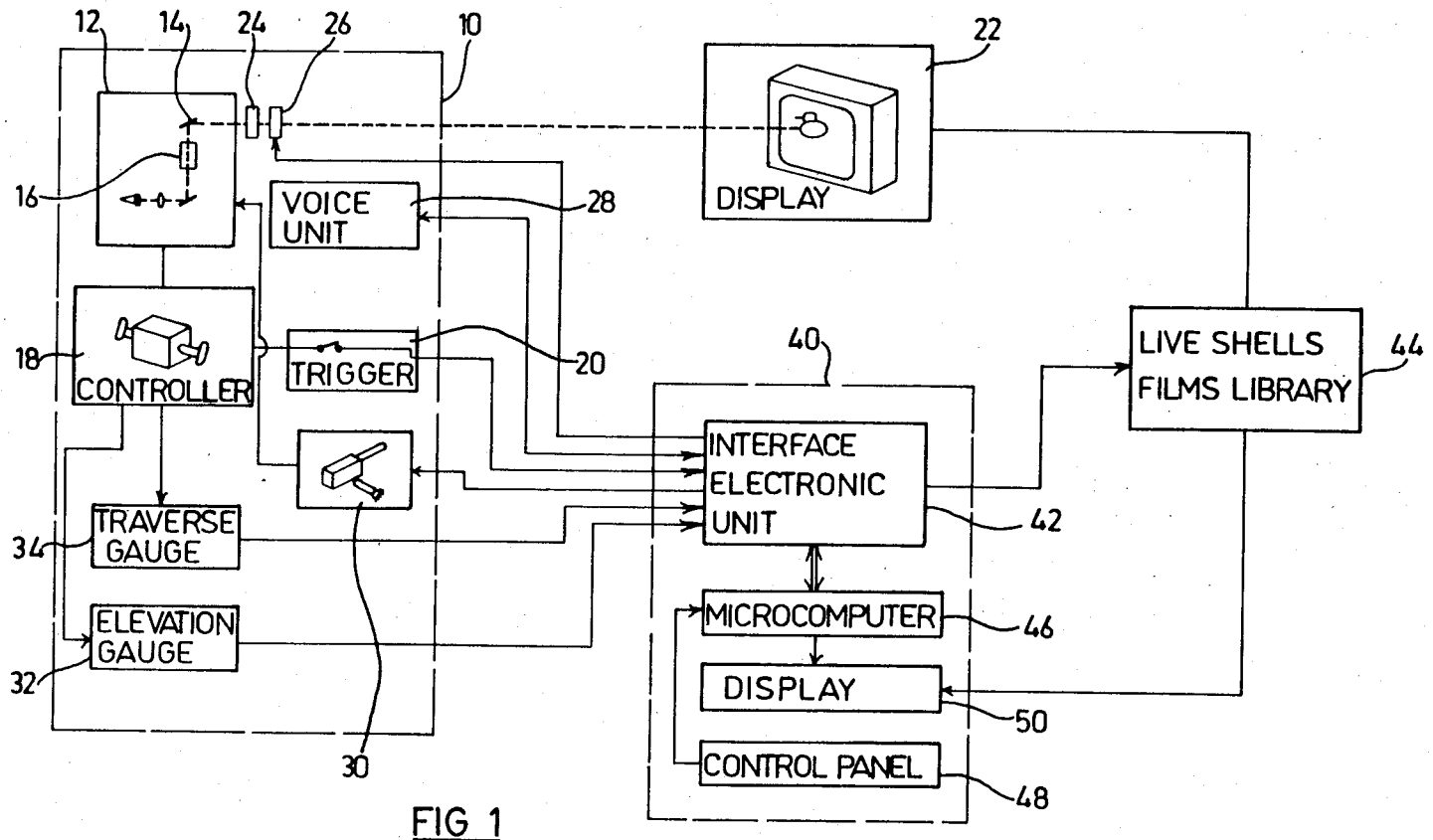
FIG. 1 is a functional block diagram illustration of gunnery training apparatus constructed and operative in accordance with an embodiment of the present invention.

Reference is now made to FIG. 1 which illustrates in block diagram form tank gunnery training apparatus constructed and operative in accordance with a preferred embodiment of the present invention. The training apparatus comprises a trainee station indicated generally by reference numeral 10. The trainee station is preferably located within an actual tank, so as to give the trainee as much as possible the feel of combat. Alternatively the trainee station may be located at any desired location such as in an ordinary room.

A fire control unit is located at the trainee station. The fire control unit includes a viewing portion 12 which comprises an aiming sight 14. Associated with the aiming sight is a reticle 16, which typically defines a cross hair which can be aimed by the gunner on the target.

The fire control unit also comprises a gun position controller 18 which permits azimuthal rotation of the gun turret of a tank relative to the tank hull and also permits raising and lowering of the gun barrel with respect to the turret. Also included in the fire control unit is a trigger 20 which is operative to initiate simulated firing.

It is appreciated that according to a preferred embodiment of the invention, the entire fire control unit should be identical, insofar as possible, to the fire control unit of a conventional tank for the operation of which the trainee is being trained. Alternatively, the various elements of the fire control unit may be constructed in any suitable manner from any suitable components, including any combination of optical, electrical, electronic and mechanical components so as to provide insofar as possible a realistic representation of actual conditions during firing at an acceptable cost in terms of manufacture and operation of the training apparatus.

Disposed in optical line of sight relationship with aiming sight 14 is a display 22, typically a video display which, as will be described hereinafter in detail, provides a dynamic color visual display of a target and of an incoming projectile impinging thereon. It is noted that the term "video" is used throughout the specification and claims in its general sense, meaning visually sensible, and is not limited to any particular technology, such as video disks, which are used in accordance with a preferred embodiment of the invention but without limitation thereto. Disposed along the optical path between sight 14 and display 22 is an optical adapter 24 operative to compensate for optical distortions and errors and to cause the image of the target on display 22 to appear, insofar as possible, identical to the appearance of a corresponding real target to a trainee looking through the reticle 16 and the aiming sight 14.

Also disposed in optical communication with aiming sight 14 is a flash and temporary obscuration unit 26 which provides a flash and subsequent temporary obscuration of the trainee's field of view, in order to simulate the flash produced by firing and the subsequent temporary lack of view of the target due to dust and smoke produced by the firing in the vicinity of the firing tank or other equipment.

There is also provided in operative association with the trainee station 10 a sound unit 28 which has a multiple function, both to provide intercommunication with an instructor or to provide prerecorded instructions to the trainee and/or to provide a sound input to the trainee to simulate the sounds produced during firing. All of part of the sound input may be recorded and accessed together with the video information on video disks.

Additionally in accordance with a preferred embodiment of the present invention, there is provided a barrel jump simulator 30 which is operative to apply to the trainee a force simulating some of the forces encountered during firing. According to a preferred embodiment of the invention, the barrel jump simulator 30 comprises a hydraulic piston or other suitable force transducer which is operative to provide a sudden displacement of "kick" to the sight, or alternatively to the entire trainee station, as desired. Normally, the sudden displacement produced by the barrel jump simulator 30 is intended to simulate only the gun recoil. Alternatively, a recoil simulator may be provided to simulate the recoil forces on the tank hull itself and the resulting displacement.

There is provided in operative association with the fire control unit of the trainee station first and second gun orientation gauges including a gun elevation gauge 32 and a gun azimuth gauge 34. Where the trainee station includes an actual gun and turret, gauges 32 and 34 may be conventional gauges used on guns and turrets to measure elevation and azimuth. Where the trainee station does not include an actual gun and turret, gauges 32 and 34 are simulated and calibrated to provide elevation and azimuth outputs corresponding to the simulated position of the gun produced by the trainee's operation of the controller 18.

The operation of the gunnery training apparatus described herein is governed by a control assembly 40 which may or may not be located adjacent the trainee station 10. The control assembly 40 comprises interface circuitry 42 which interfaces with the apparatus described hereinabove in connection with the trainee unit. More particularly, the interface circuitry 42 receives inputs from the elevation and azimuth sensors 32 and 34, from the trigger 20 and controller 18 and from the sound unit 28. The interface circuitry provides outputs to the sound unit 28 to the flash and temporary obscuration unit 26, and to the barrel jump simulator 30.

The interface circuitry also provides an output signal to conventional industrial video disk apparatus 44 which contains a library of film portions corresponding to the trajectory of actual projectiles fired at a target from a plurality of different gun orientations, as seen by a gunner through aiming sight 14 and corresponding to the available permutations of orientations realizable by a trainee employing controller 18. It may thus be appreciated that the library of film portions contained in video disk apparatus 44 enables a correct corresponding dynamic view of the gun trajectory to be displayed to the trainee exactly as it would be seen by a gunner in the same position during actual firing. It is particularly noted that in contrast to prior art apparatus, the present invention provides a dynamic, changing view of the target continuously from before firing to after impingement of the projectile instead of discrete static fixed images before and after projectile impingement as in the prior art. It is therefore appreciated that, from the viewpoint of what the trainee sees through the reticle 16, the view is identical to what the gunner sees continuously from a time before commencement of gun aiming to after impingement of the projectile on the target.

Further in accordance with an embodiment of the present invention, the film portions stored in the film library of the video disk apparatus are sound films and thus provide concurrent video and sound tracks actually recorded during actual firing. It is appreciated that other types of retrieval systems other than video disks may be used provided that they have sufficient reliability, quality and quick response time. There is also provided in control assembly 40, a microcomputer 46 of conventional construction and operation which is operative to coordinate the operation of the entire apparatus and in particular to instruct the video disk apparatus 44 as to which film of the library corresponds to the indicated orientation of the gun as indicated by gauges 32 and 34. Associated with the microcomputer 46 is a control panel 48 which may be operated by an instructor.

A display 50 may also be provided for the instructor. Where the instructor is located in suitable propinquity to the trainee station, display 50 may be eliminated and display 22 may be viewable also by the instructor. Also, the information appearing on display 22 may also appear on display 50. Thus display 50 may be understood to operate both as a CRT display for computer generated information and as a video display. Additional computer generated information, including firing data, corrections, summaries, etc. also may be displayed on either or both of displays 22 and 50.

It is a particular feature of the present invention that the time response of the display is substantially real time from the standpoint of occurances that occur in an actual firing situation. Thus, if, for example, in actual firing, trigger actuation takes place at time t 1, the flash and subsequent obscuration takes place at time t 2–t 10 and the projectile trajectory is viewable by the gunner from time t 5–t 35, the display and ancillary apparatus of the training apparatus described herein produce the simulated effects of these occurances in substantially the same time frame. It is noted that the response time of a conventional industrial video disk in this particular application, about one second, does not produce substantially any distortion to the time frame since the duration of the visual obscuration is normally in excess of this response time.

In actual firing the time relationships are of the order of 200 msecs. between trigger actuation and flash; up to 1.5 seconds of flash and temporary obscuration, followed by the gunner's view of the projectile trajectory. The gunner sees the projectile trajector for approximately 0–4 seconds and thereafter may see evidence of impingement of the projectile at the target.

Figure 2:
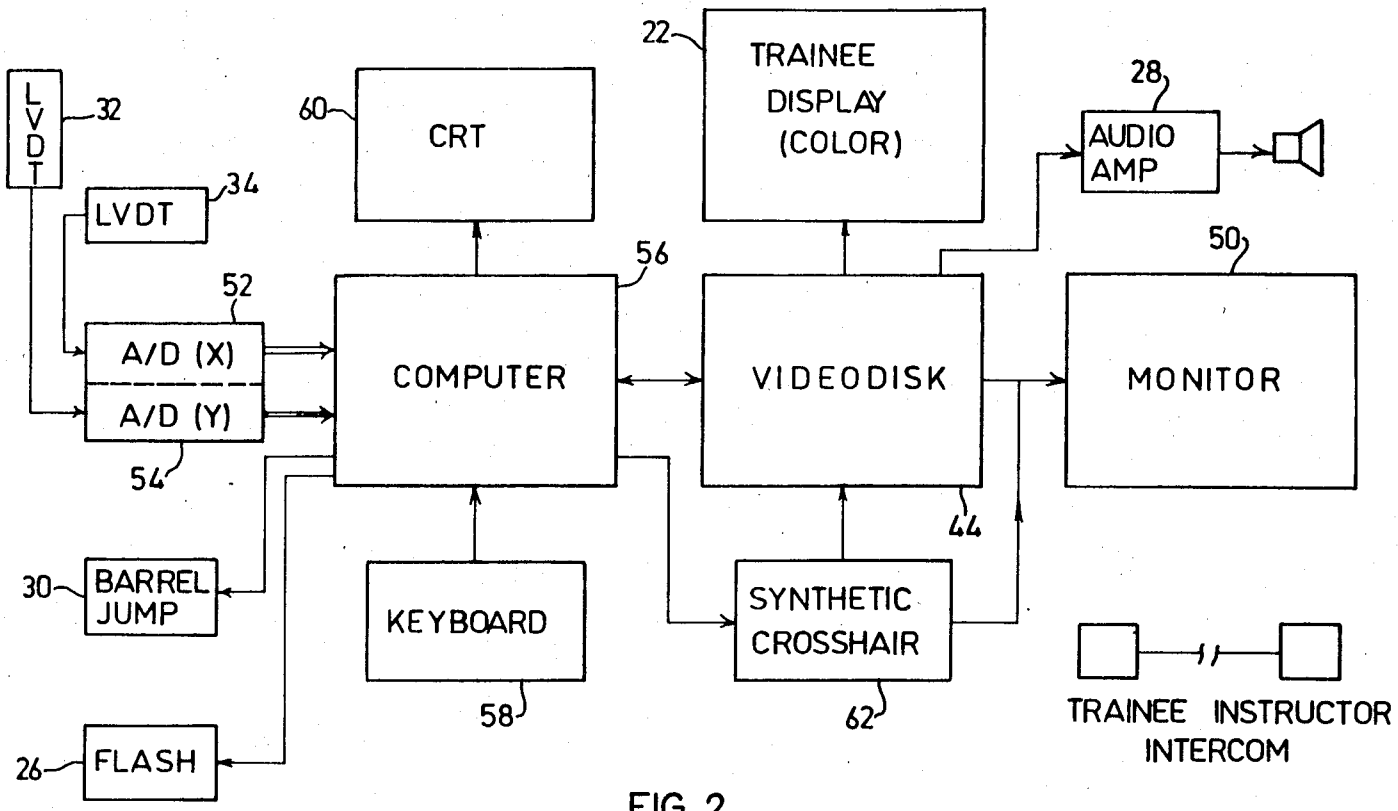
FIG. 2 is an electronic block diagram of the circuitry of the apparatus of FIG. 1.

Reference is now made to FIG. 2 which is an electronic block diagram of the circuitry employed in the embodiment of FIG. 1. It is seen from FIG. 2 that the sensors 32 and 34 are coupled via A–D converters 52 and 54 to a CPU 56 such as a 8085 or a personal computer such as an HP-85. The recoil simulation unit and the flash and temporary obscuration unit 26 receive outputs from the CPU. The CPU 56 also interfaces with a keyboard 58 which forms part of the control panel 48 (FIG. 1) with an optional display 60, and with the video disk apparatus. Video disk apparatus 44 interfaces with display 22 and with optional display 50 (FIG. 1). Since the video disk apparatus is also capable of storing of a library of sound film portions, a direct interface may be provided from the video disk apparatus 44 to the sound unit 28.

A synthetic computer generated crosshair reticle may be provided on display 50 by means of circuitry 62 which interfaces with CPU 56 and with the output of video disk apparatus 44. As noted above, various data such as firing data may also be provided on displays 22 and 50.

Figure 4:
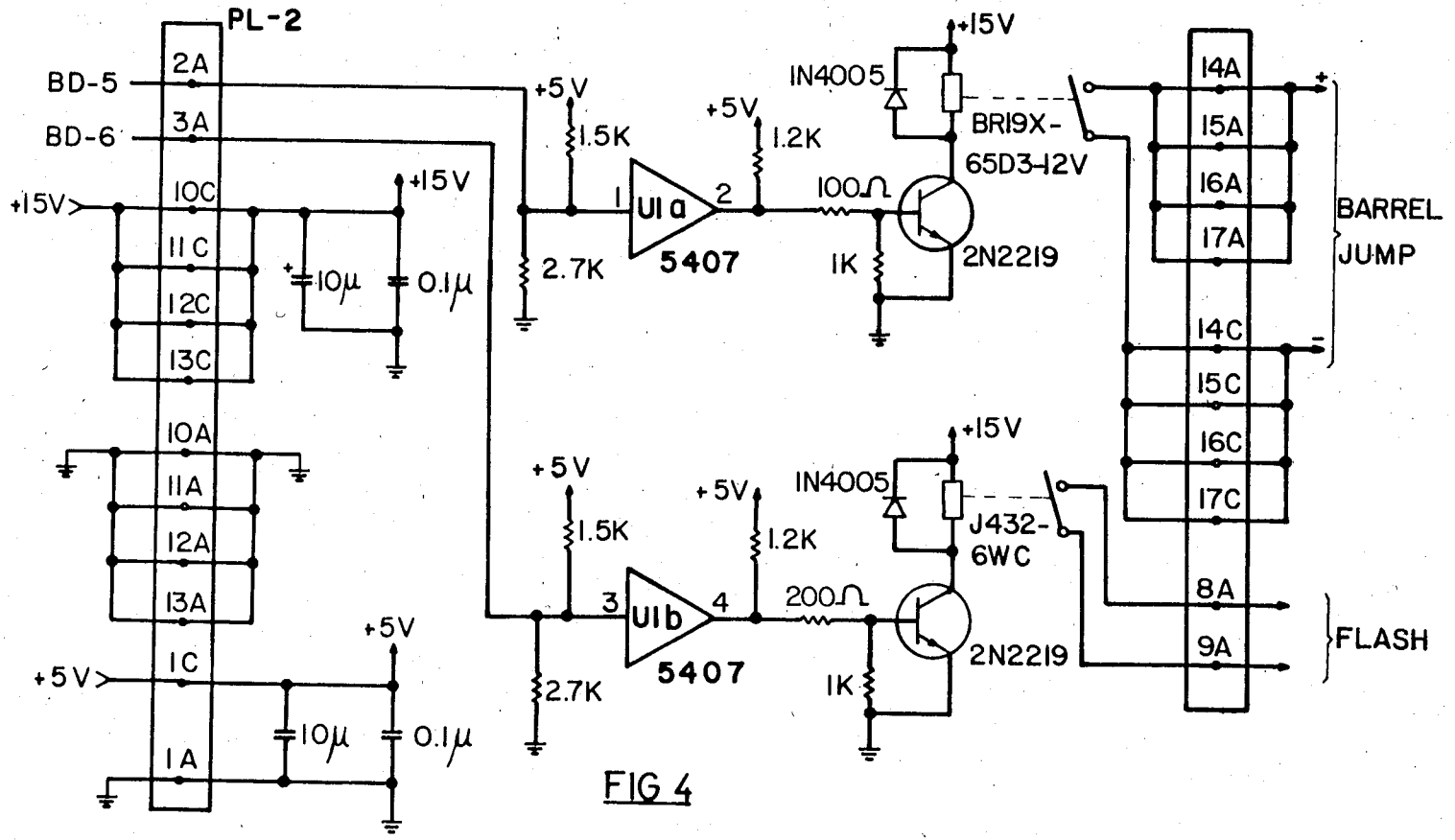
FIG. 4 is a schematic illustration of the circuitry employed in providing simulated recoil force and flash in accordance with a preferred embodiment of the invention.

FIG. 3 is a schematic illustration of A–D converter circuits 52 and 54. FIG. 4 is a schematic illustration of the actuation circuitry which interfaces between the CPU 56 and units 26 and 30. FIG. 5 is a schematic illustration of interface circuitry which couples the CPU with the video disk apparatus 46.

Figure 6:
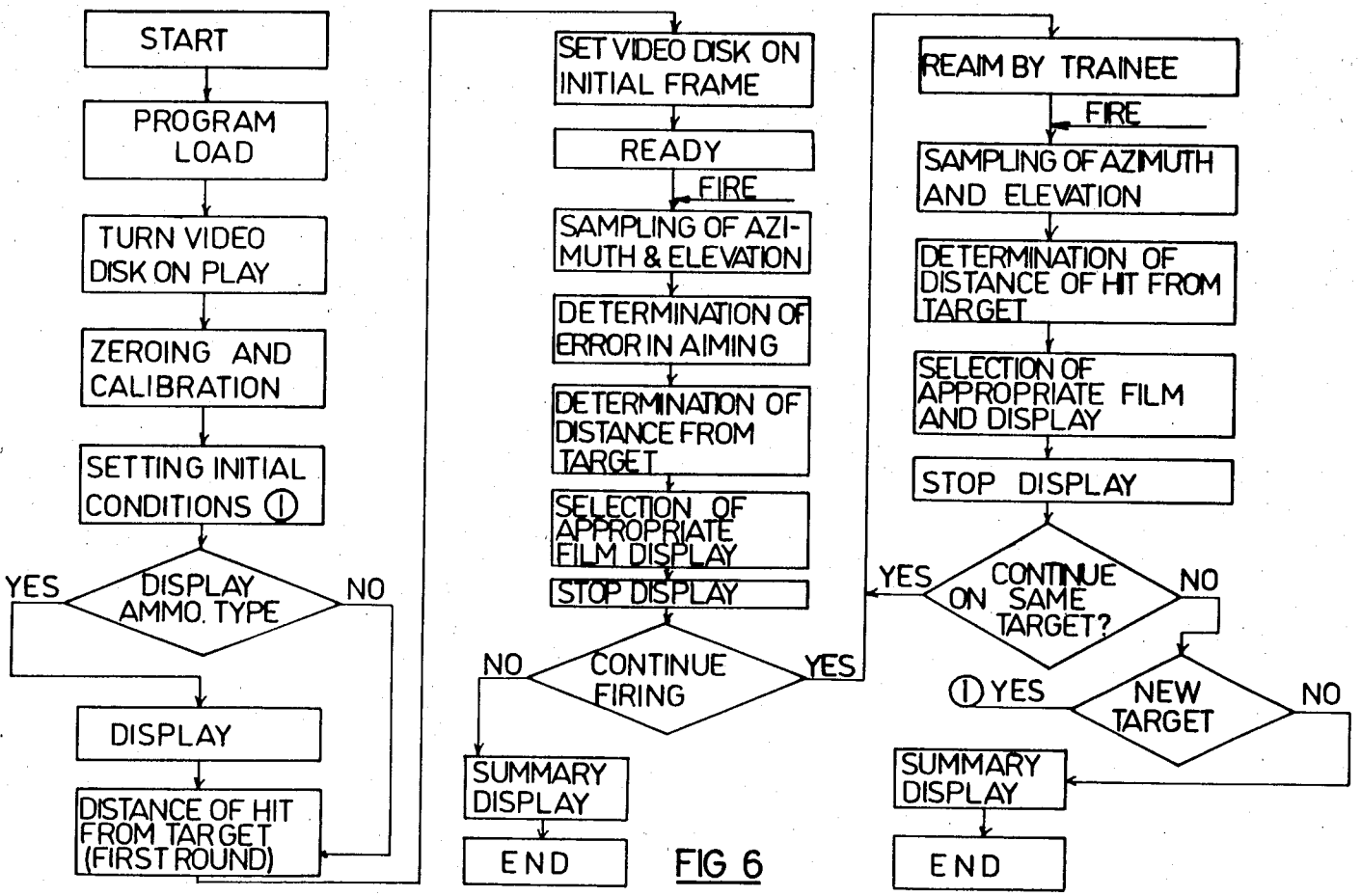
FIG. 6 is a general flow chart illustrating the operation of the gunnery training apparatus constructed and operative in accordance with a preferred embodiment of the present invention.

Reference is now made to FIG. 6 which illustrates in flow-chart form, the operation of the gunnery training apparatus of the present invention. The operation begins with the provision of a START command, which may be provide by a suitable switch on an operating panel or keyboard. A PROGRAM LOAD instruction is then provided which results in turning the video disk apparatus onto its PLAT setting. Zeroing and calibration of the apparatus is then provided followed by the setting of initial conditions for the first firing.

If desired, a display of the type of ammunition being used and firing data may be provided. The control circuitry then determines the distance by which the simulated projectile fired in the first firing will miss the target. In accordance with this distance an appropriate film from the video disk film library corresponding to the selected type and distance of miss for the selected target is chosen and the video disk is set on the initial frame of such selected film. The apparatus is now ready for the first firing by the trainee.

The trainee then pulls the trigger to fire. The control circuitry samples the set azimuth and elevation determined by the firing controller in assdociation with the elevation and azimuth gauges and calculates the error in aiming and the distance by which the simulated projectile fired in the first firing missed the target. The appropriate film is selected from the library of films and corresponds to the type and distance of miss for the selected target. This film, which may include both video and sound components, is displayed in the appropriate time frame and the display is then stopped. It is noted that appropriate additional stimuli are also provided by the control circuitry at the appropriate times relative to firing, as described hereinabove.

If it is not desired to continue simulated firing, a summary of the firing results so far is displayed and operation of the apparatus is terminated. If, however, it is desired to continue simulated firing at the same target, the trainee is permitted to re-aim and to fire again. The azimuth and elevation determined by the aiming of the trainee are sampled, as previously and the distance of the hit from the target is determined. An appropriate film showing impingement of the projectile on the target with the appropriate type and distance of miss is selected and displayed.

Upon termination of the display, if it desired to continue on the same target, the trainee returns to step 2, reaiming. Otherwise, if a new target is desired, the apparatus returns to step 1, setting appropriate initial conditions. If a new target is not desired, a summary of the firing results may be displayed and operation of the apparatus may be terminated.

It will be appreciated by persons skilled in the art that the present invention is not limited by what has been particularly shown and described hereinabove by way of example. Rather the scope of the invention is defined only by the claims which follow.

What is claimed is:

1. A fully recorded image gunnery training system comprising:

a fire control unit located at a trainee location and including:

an aiming sight;

an aiming controller operative to control the orientation of an actual or simulated gun; and a trigger;

a display viewable through said aiming sight and providing a field of view of a simulated target through said aiming sight corresponding to the actual view of an actual target through the aiming sight of an actual gun;

means for sensing the orientation of said gun produced by operation of said aiming controller by a trainee;

means for determining the trajectory of a simulated projectile relative to said simulated target in accordance with the orientation produced by operation of said aiming controller by said trainee;

means to store a plurality of video records of actual recorded projectile firings said storing means including a video disc library having video records each of about 3–8 seconds duration and including the continuous dynamic effects in the trajectory as would be seen from the location of said actual gun with projectile impact and accompanying sounds for various orientations of said actual gun relative to said actual target corresponding to said simulated target shown on said display means for accessing said video disc library to display said video to the user; and means responsive to operation of said trigger and to an output from said determining means for selecting a video record from said library and displaying it on said display in a time relationship to trigger actuation by the trainee which corresponds generally to the time relationship between trigger actuation and the displayed events in actual firing.

2. A system according to claim 1 and also comprising means for providing additional sensible stimuli to the trainee in response to trigger actuation and in a time relationship thereto which corresponds to the application of such stimuli to a gunner during actual firing.

3. A system according to claim 2 and wherein said sensible stimuli simulate the sounds of firing.

4. A system according to claim 2 and wherein said sensible stimuli simulate the sounds of impacting projectile as heard by a gunner.

5. A system according to claim 2 and wherein said sensible stimuli include visual stimuli which simulate the flash produced by firing and the temporary obscuration of the gunner's vision occuring immediately after firing.

6. A system according to claim 2 and wherein said sensible stimuli include force stimuli to simulate the recoil of the gun.

7. A system according to claim 2 and also comprising instructor monitoring means arranged to enable an instructor to view the same display seen by the trainee.

8. A system according to claim 2 and wherein said accessing means comprises a conventional industrial video disk player.

9. A system according to claim 2 wherein said gunnery training system is a tank trainer.

10. A system according to claim 1 and also comprising instructor monitoring means arranged to enable an instructor to view the same display seen by the trainee.

11. A system according to claim 1 and wherein said accessing means comprises a conventional industrial video disk player.

12. A system according to claim 1 wherin said gunnery training system is a tank trainer.

* * * * *